US008534990B2

(12) United States Patent
Duong et al.

(10) Patent No.: US 8,534,990 B2
(45) Date of Patent: Sep. 17, 2013

(54) INLET GUIDE VANE DRIVE SYSTEM WITH SPRING PRELOAD ON MECHANICAL LINKAGE

(75) Inventors: Loc Quang Duong, San Diego, CA (US); Xiaolan Hu, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 912 days.

(21) Appl. No.: 12/616,384

(22) Filed: Nov. 11, 2009

(65) Prior Publication Data

US 2011/0110765 A1 May 12, 2011

(51) Int. Cl.
*F01D 5/00* (2006.01)

(52) U.S. Cl.
USPC ..... 415/119; 415/163

(58) Field of Classification Search
USPC ..... 415/119, 159, 160, 161, 162, 163, 415/164, 165; 92/143, 130 R, 135
See application file for complete search history.

(56) References Cited

U.S. PATENT DOCUMENTS 2,327,647 A * 8/1943 Jandasek ..... 477/66
2,382,913 A * 8/1945 Robinson ..... 415/148
3,685,921 A * 8/1972 Dekeyser ..... 415/159
3,799,689 A * 3/1974 Moriguti et al. ..... 415/26
4,050,844 A 9/1977 Miller et al.
4,090,812 A * 5/1978 Moran ..... 416/133
4,300,869 A 11/1981 Swearingen
4,470,754 A 9/1984 Manente, Jr. et al.
4,798,514 A 1/1989 Pask
4,834,614 A 5/1989 Davids et al.
4,889,469 A 12/1989 Wilkinson
4,890,977 A * 1/1990 Tremaine et al. ..... 415/164
5,269,651 A 12/1993 Ostermeir et al.
7,140,839 B2 11/2006 McAuliffe et al.
7,396,206 B2 7/2008 Humhauser
7,448,848 B2 11/2008 Alexander et al.
7,458,221 B1 12/2008 Arnold et al.
7,549,839 B2 6/2009 Carroll et al.
7,588,415 B2 9/2009 Giaimo et al.

* cited by examiner

*Primary Examiner* — Nathaniel Wiehe
*Assistant Examiner* — Adam W Brown
(74) *Attorney, Agent, or Firm* — Carlson, Gaskey & Olds, PC

(57) ABSTRACT

A variable vane system includes a plurality of vanes each being pivotal about an axis. A mechanical linkage drives the plurality of vanes to rotate about the axis. The mechanical linkage includes a ring gear to rotate, and in turn drive the plurality of vanes. There is at least one rod to drive the ring gear to rotate. The rod is driven by a hydraulic servo motor. A spring bias force is provided in the mechanical linkage to resist either translational or rotational oscillation.

4 Claims, 3 Drawing Sheets

INLET GUIDE VANE DRIVE SYSTEM WITH SPRING PRELOAD ON MECHANICAL LINKAGE

BACKGROUND OF THE INVENTION

This application relates to a mechanical linkage for driving a compressor inlet guide vane system for gas turbine engines, wherein a spring preload is included into the mechanical linkage.

Gas turbine engines include a compressor which compresses air and delivers it into a combustion section where it is mixed with fuel and burned. Products of this combustion pass downstream over a turbine section, driving turbine rotors to provide power to the gas turbine engine.

Inlet guide vanes typically control the flow of air to the compressor section. Variable vane systems are known. In such systems, an angle of incidence provided by the vanes, for guiding the air to the compressor, is varied depending upon the amount of air that is to be delivered to the compressor.

In one such system, a ring gear is driven to rotate through a mechanical linkage including a plurality of rods, and a hydraulic motor for driving the rods. The ring gear drives a plurality of sector gears to cause a plurality of vanes to rotate as the ring gear is driven to rotate between a full open and full closed position.

One challenge with these systems is that variables in the flow of air to the guide vanes, and the compressor, can cause vibration on the variable vanes, ring and sector gears, and across the mechanical linkage.

SUMMARY OF THE INVENTION

A variable vane system includes a plurality of vanes each being pivotal about an axis. A mechanical linkage drives the plurality of vanes to rotate about the axis. The mechanical linkage includes a ring gear meshing with a plurality of sector gears, which in turn drives the plurality of vanes. There is at least one rod to drive the ring gear to rotate. The rod is driven by a hydraulic motor. A spring bias force is provided in the mechanical linkage to resist oscillation.

These and other features of the present invention can be best understood from the following specification and drawings, the following of which is a brief description.

DETAILED DESCRIPTION OF THE PREFERRED EMBODIMENT

Figure 1:
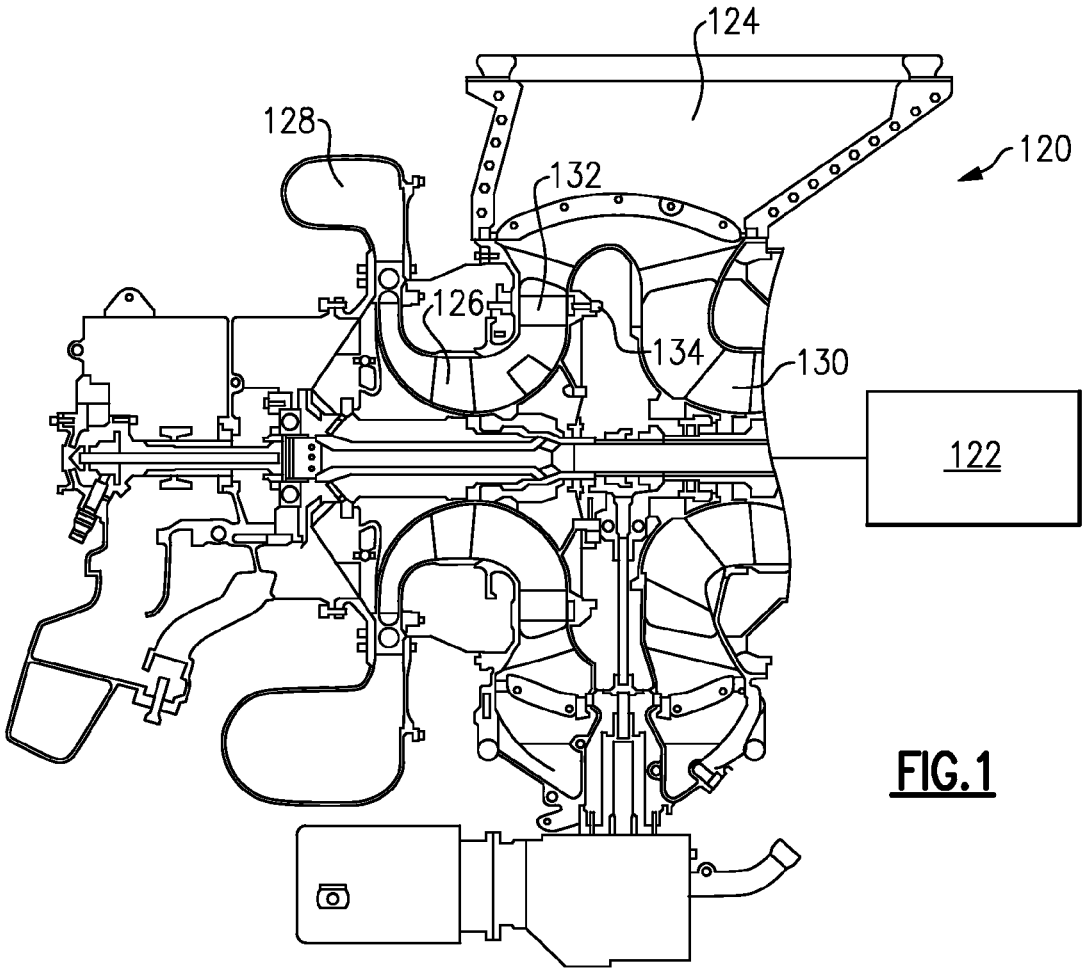
FIG. 1 shows a turbine engine.

A turbine engine 120 is illustrated in FIG. 1. A power section 122 includes a combustion section and a turbine section, as known. A compressor section delivers compressed air to the combustion section. As shown, the compressor section includes an inlet plenum 124 delivering air from a source of air past a plurality of inlet guide vanes 132 toward a low pressure impeller 126. The low pressure impeller 126 delivers air to an outlet scroll 128. A high pressure compressor 130 delivers air to the combustion section. An actuator 134 actuates the inlet guide vanes 132 to pivot. The positioning of the inlet guide vanes, and the reason for changing their positions is known, and relates to delivering a supply of air to the low pressure compressor impeller 126 in desired quantities.

Figure 2:
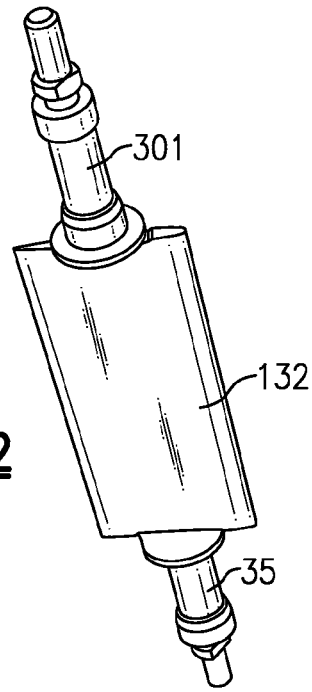
FIG. 2 shows a variable vane.

As shown schematically in FIG. 2, the inlet guide vanes 132 include pivot pins 35 and 301 which allow the orientation of the inlet guide vanes 132 to pivot, to change the angle of incidence of air approaching the low pressure impeller 126. In this manner, the amount of air delivered to the scroll 128, can be controlled. As shown, the plenum 124 also delivers air to the impeller 130. The scroll housing 128 may deliver the compressed air to downstream uses, such as the passenger cabin on an aircraft.

Figure 3:
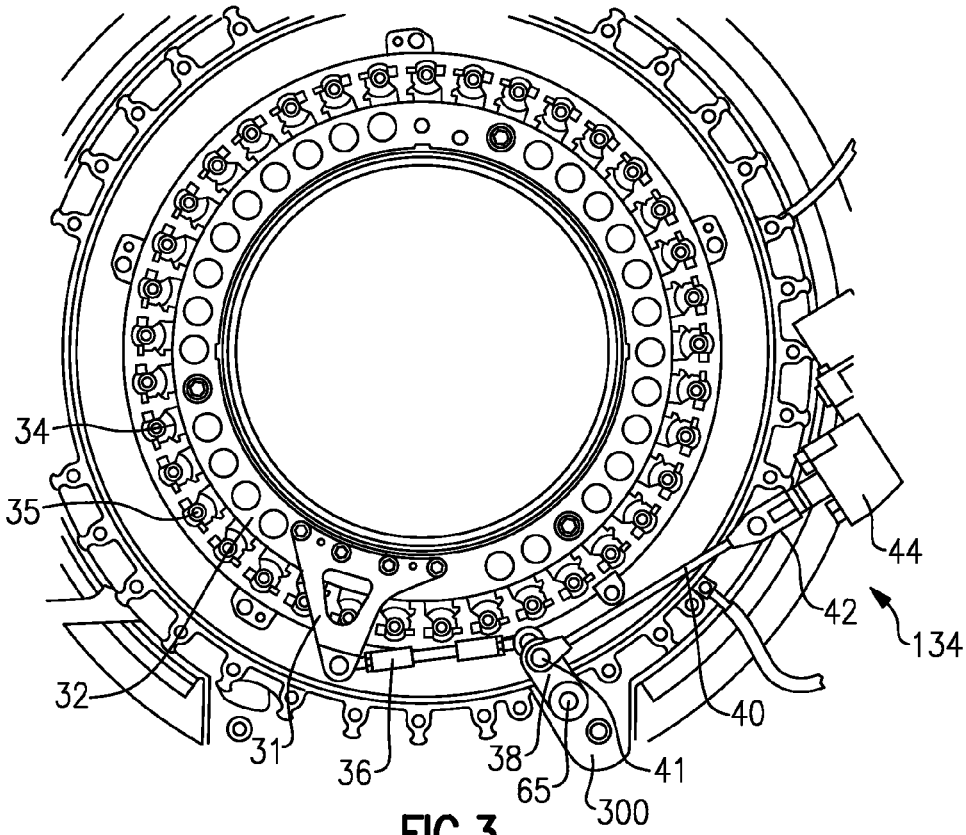
FIG. 3 shows a view of a drive system for a variable vane system.

An actuation system 134 for driving the variable vanes is illustrated in FIG. 3. The general structure may be as known. As shown, a device 31 drives a ring gear 32 to rotate. The ring gear interacts through a sector gear 34, to in turn rotate a plurality of vanes. The vane's pivot pins 35 are shown in this Figure. Actuation of the device 31 to turn the ring gear 32 is from a hydraulic servo motor 44, driving a rod 42 which is pivotally connected at 41 into a hinge knuckle 38. The hinge 38 in turn drives a second rod 36 to move the device 31, and hence the ring gear. All of these components together can be seen as a mechanical linkage for pivoting the vane.

Figure 4:
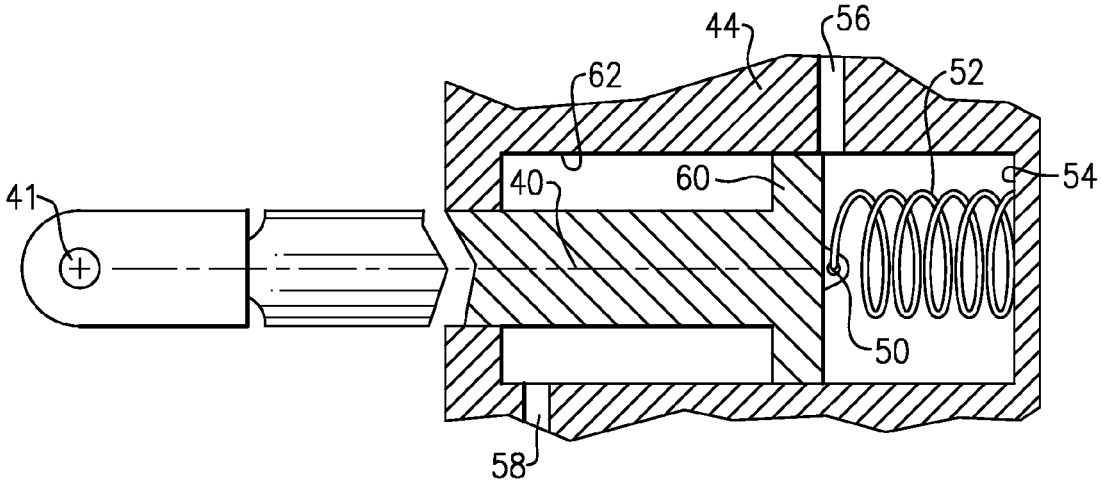
FIG. 4 shows a portion of the FIG. 3 embodiment.

FIG. 4 shows a detail of a housing incorporating the hydraulic motor 44. As shown, the rod 40 is connected to a piston head 60 movable within a fluid chamber 62. Fluid supplies 56 and 58 drive the piston 60, and hence the rod 40 to actuate the device 31, and the ring gear 32. In known systems, fuel is utilized as a hydraulic fluid to move the piston 60. In this embodiment, a progressive helical spring 52 is connected between an end 50 of the rod 40 and an end wall 54 of the housing. The progressive helical spring has an increasing spring force which increases as the rod 40 moves to compress the spring. Thus, the spring resists translational oscillation or vibration on the rod if such is transmitted to the rod through the ring gear and from the vanes. Thus, the spring will hold the entire mechanical linkage more static and resist the tendency to oscillate due to such variable applied forces.

Figure 5:
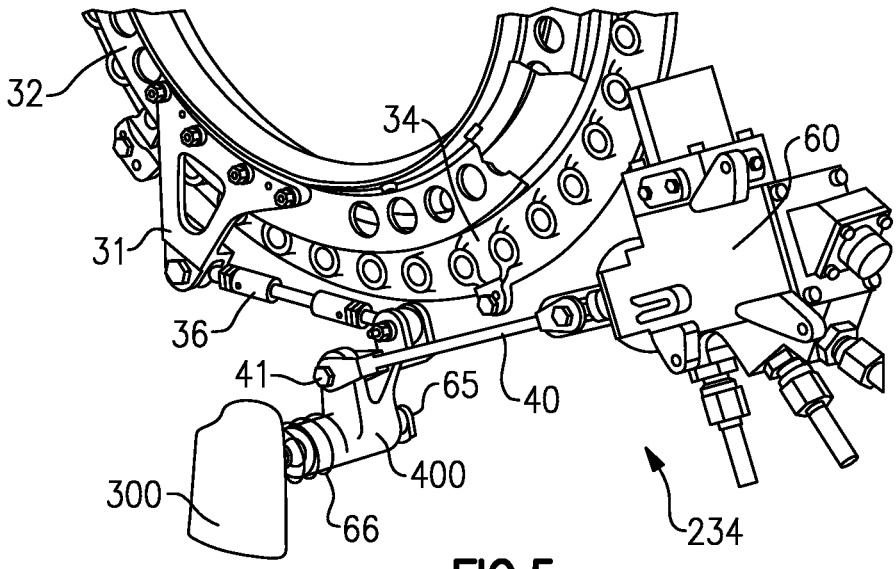
FIG. 5 shows another portion of the variable vane system.
Figure 6:
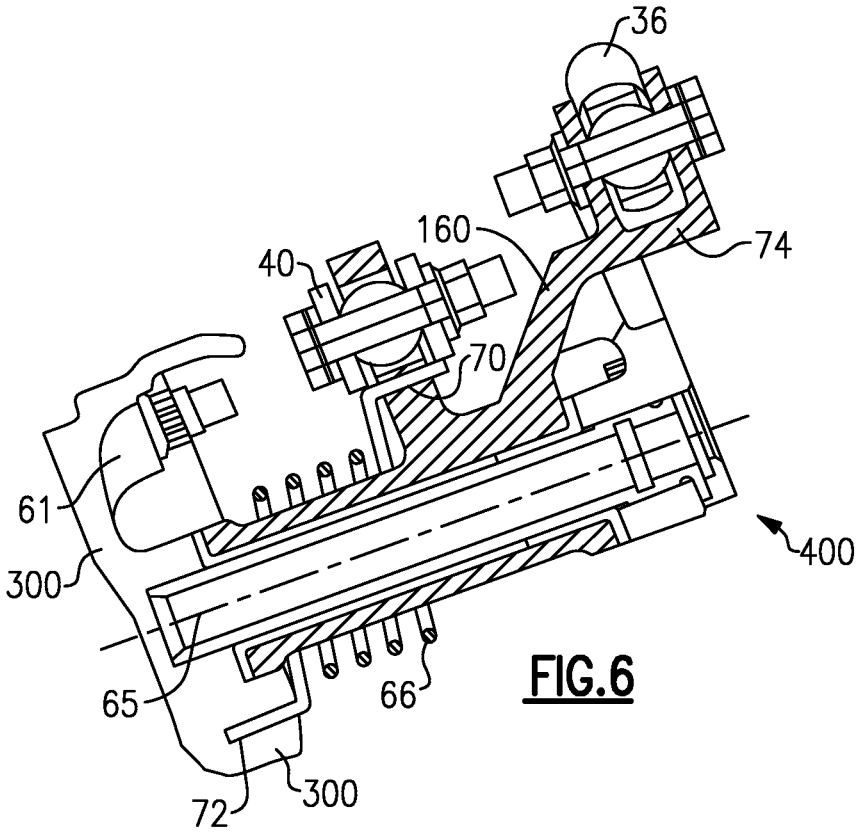
FIG. 6 shows a second embodiment of the invention.

FIG. 5 shows a second embodiment 234. Second embodiment 234 includes the rod 40 pinned at 41, and the rod 36 driving the device 31 as in the prior embodiment. However, the spring is not included in the hydraulic motor 60 in this embodiment. Instead, a spring 66 is included into the hinge knuckle 400 as shown in FIG. 6. As shown, the rod 36 is driven by a pivot housing 160 carrying an arm 74 that in turn drives the rod 36. A pin 65 mounts the pivot housing 160 for pivotal movement relative to a fixed housing 300 (see FIG. 3) as driven by the rod 40.

As can be appreciated from these Figures, as the rod 40 is driven to move inwardly and outwardly of the housing of the hydraulic motor 60, it causes pivot housing 160 to pivot on the pin 65. This causes the rod 36 to also move toward and away from the device 31, and in turn cause the device, and hence the ring gear, to rotate.

Spring 66 is shown schematically in FIG. 5, and in more detail in FIG. 6. As can be appreciated, one end 72 of the spring sits against the fixed housing 300. The other end 70 of the spring 66 sits against the pivot housing 160. Thus, the spring 66, which again may be a progressive spring, resists torsional oscillation delivered into the mechanical linkage, and from the rod 36 back toward the hydraulic motor 60. Attachment points for each of the first and second rods to the pivot housing are provided, both being on the same side of the pivot pin 65.

With either of the disclosed embodiments, the spring will resist any oscillation in the mechanical linkage that might be imposed by variable flow characteristics such as vortices, etc.

Although embodiments of this invention have been disclosed, a worker of ordinary skill in this art would recognize that certain modifications would come within the scope of this invention, such as using torsional spring at sector gear locations. For that reason, the following claims should be studied to determine the true scope and content of this invention.

What is claimed is:

1. A variable vane system comprising:

a plurality of vanes each being pivotal about an axis;

a mechanical linkage for driving said plurality of vanes to rotate about said axis, said mechanical linkage including a ring gear, a plurality of sector gears for rotating, and in turn driving said plurality of vanes to rotate about said axis, and the mechanical linkage including at least one first rod for driving said ring gear to rotate, said first rod driven by a hydraulic servo motor, and the mechanical linkage including a spring bias force, and resisting oscillation;

said mechanical linkage includes a hinge knuckle, said first rod causing said hinge knuckle to rotate, to in turn transmit rotation to a second rod, said second rod connected to drive said ring gear, said ring gear configured to rotate, and said spring being a torsional spring to resist torsional oscillation of said ring gear; and said mechanical linkage includes a pivot housing which is configured to pivot about a pin mounted within a fixed housing, said spring including a first end sitting against a portion of said fixed housing, and a second end sitting against a surface on said pivot housing to resist oscillation.

2. The system as set forth in claim 1, further including attachment points for each of said first and second rods to said pivot housing, said attachment points both being on the same side of said pin.

3. A variable vane system comprising:

a plurality of vanes each being pivotal about an axis;

a mechanical linkage for driving said plurality of vanes to rotate about said axis, said mechanical linkage including a ring gear and a plurality of sector gears for rotating, and in turn driving said plurality of vanes to rotate about said axis, said ring gear being fixed to a device, and the mechanical linkage including at least one first rod for driving said device, said device configured to rotate, said first rod being driven by a hydraulic servo motor, and there being a spring bias force in said mechanical linkage resisting oscillations;

said spring being a progressive spring including a non-linear spring stiffness;

said mechanical linkage includes a hinge knuckle, said first rod driving said hinge knuckle, said hinge knuckle configured to rotate, to in turn transmit rotation to a second rod, said second rod being connected to drive said ring gear, said ring gear configured to rotate, and said spring being a torsional spring to resist oscillation of both said first and second rods; and wherein said mechanical linkage includes a pivot housing which pivots about a pin mounted within a fixed housing, said spring including one end sitting against a portion of said fixed housing, and a second end sitting against a surface on said pivot housing to resist oscillation.

4. The system as set forth in claim 3, wherein attachment points for each of said first and second rods to said pivot housing are provided, and said attachment points both being on the same side of said pin.

* * * * *